US012121131B1

(12) United States Patent
Alsaud

(10) Patent No.: US 12,121,131 B1
(45) Date of Patent: Oct. 22, 2024

(54) ROTATABLE CUTTER-INTEGRATED DISPENSING STICK FOR HYGIENIC AND PRESERVATIVE PRODUCT APPLICATION

(71) Applicant: Sarah Faisal Alsaud, Beaverton, OR (US)

(72) Inventor: Sarah Faisal Alsaud, Beaverton, OR (US)

( * ) Notice: Subject to any disclaimer, the term of this patent is extended or adjusted under 35 U.S.C. 154(b) by 0 days.

(21) Appl. No.: 18/382,544

(22) Filed: Oct. 23, 2023

(51) Int. Cl.
*A45D 40/04* (2006.01)
*A45D 40/00* (2006.01)
*A45D 40/08* (2006.01)
*A45D 40/10* (2006.01)

(52) U.S. Cl.
CPC ..... *A45D 40/04* (2013.01); *A45D 40/10* (2013.01); *A45D 2040/0006* (2013.01); *A45D 40/08* (2013.01)

(58) Field of Classification Search
CPC ..... A45D 40/04; A45D 40/10; A45D 2040/0006; A45D 40/00; A45D 2040/0025; A45D 40/02; A45D 40/06; A45D 40/08; A45D 14/14
USPC ..... 401/50–52, 195
See application file for complete search history.

(56) References Cited

U.S. PATENT DOCUMENTS 5,178,478 A * 1/1993 Ryder ..... A45D 40/18 401/195
2010/0054846 A1* 3/2010 Hartman ..... B43K 24/00 401/198

* cited by examiner

*Primary Examiner* — David J Walczak
(74) *Attorney, Agent, or Firm* — Sarah Faisal Alsaud

(57) ABSTRACT

A dispensing stick designed for products such as lip balm, lipstick, or glue. The dispensing stick features a cylindrical body with an actuator mechanism at one end and an opening at the other for dispensing the product. Notably, the dispensing stick incorporates a rotatable disc-shaped cutter element, hinged to the cylindrical wall adjacent to the opening. This cutter element, equipped with a curved blade, is coupled to the body via a pin and operates in a plane parallel to the opening. The design allows for a cutting action as the product is pushed through the opening, thereby addressing issues related to product hygiene and longevity.

14 Claims, 3 Drawing Sheets

ROTATABLE CUTTER-INTEGRATED DISPENSING STICK FOR HYGIENIC AND PRESERVATIVE PRODUCT APPLICATION

FIELD OF INVENTION

The present invention relates generally to dispensing mechanisms for semi-solid products. More specifically, the invention pertains to a dispensing stick designed for hygienic and preservative dispensing of products such as lip balm, lipstick, and glue, incorporating a rotatable disc-shaped cutter element adjacent to the dispensing opening.

BACKGROUND

The field of personal care and adhesives has seen considerable advancements in the realm of dispensing mechanisms for products like lip balm, lipstick, and glue sticks. A prevalent design in the market consists of a cylindrical stick that employs an actuator at the bottom to push the product upwards, making it accessible for application. Despite its widespread use, this design poses a number of issues that impact the quality and longevity of the dispensed product.

In conventional dispensers, the actuator mechanism pushes the entire mass of the product upwards, exposing it to ambient air. This can lead to the product drying out over time, thereby affecting its efficacy. Furthermore, the consumer frequently uses these products in varied environments and situations, such as after eating, drinking, or other activities that involve contact with the lips. Each of these instances introduces the risk of contamination, from saliva to outside air pollutants. The lack of a protective mechanism in the current designs puts the integrity of the product at stake, making it susceptible to spoilage and diminishing its shelf life.

Moreover, the design does not lend itself well to maintaining hygiene. Repeated exposure to contaminants and no means of effectively shielding the unused portion of the product can lead to bacterial growth and/or fungal growth, thereby posing health risks to the user.

Thus, the limitations of the current dispensing mechanisms have underscored the need for an innovative solution that addresses these drawbacks, ensuring product integrity while enhancing its usability and longevity. This provides the context and rationale for the development of a new dispensing stick design aimed at overcoming the identified challenges.

It is within this context that the present invention is provided.

SUMMARY

The present invention relates to a dispensing stick design primarily suited for dispensing lip balm, lipstick, or glue stick in a manner that addresses issues of hygiene and product longevity. The invention includes a dispensing stick with a novel lid design that incorporates a rotatable disc-shaped cutter or blade element. This cutter is hinged to the cylindrical wall of the stick body and performs a cutting action along the plane through which the stick of the dispensed product is pushed. Thus, according to an aspect of the present disclosure, there is provided a dispensing stick for dispensing a product, the dispensing stick comprising: a cylindrical body having an inner cavity for storing the product and an opening at one end for dispensing the product; an actuator mechanism located at the opposite end of the cylindrical body, operable to push the product through said opening; a rotatable disc-shaped cutter element, having a curved blade protruding from one edge, hingedly coupled to the cylindrical wall of said body adjacent to said opening; a pin coupling said disc-shaped cutter element to said cylindrical body, wherein said pin is positioned at one outer edge of said disc-shaped cutter element; an aperture in the wall of said cylindrical body at the point of coupling, allowing said disc-shaped cutter element to rotate around said pin along a plane parallel to the opening of the cylindrical body.

In some embodiments, the disc-shaped cutter or blade element is integrated into the end of the dispensing stick body that is covered by the lid. If the stick body itself is cylindrical, the disc may be shaped in a circular or semi-circular profile. A curved blade protrudes from one edge of the disc.

In some embodiments, the disc element is coupled to the stick body by a pin at one outer edge. The walls of the stick body at the point of mounting have an opening, allowing the disc to spin freely around the pin in the cutting plane.

In some embodiments, the actuating mechanism for dispensing the product remains similar to those found in known designs. This allows for the cutting lid to be retrofitted to existing dispensing sticks, such as those for lip balm, lipstick, or glue. In some embodiments, the actuator mechanism is a spring-loaded mechanism. In some embodiments, the removable top lid includes a locking mechanism to secure said lid onto the cylindrical body. In some embodiments, the disc-shaped cutter element is configured to cut the product once the actuator mechanism has pushed the product through the opening. In some embodiments, the curved blade of the disc-shaped cutter element is replaceable. In some embodiments, the cylindrical body is comprised of a material selected from the group consisting of plastic, metal, and biodegradable materials. In some embodiments, the aperture in the wall of the cylindrical body is elongated to guide the rotation of the disc-shaped cutter element. In some embodiments, the pin coupling the disc-shaped cutter element to the cylindrical body is made of a material selected from the group consisting of metal and plastic. In some embodiments, the dispensing stick further comprises a sealing gasket positioned between the disc-shaped cutter element and the opening of the cylindrical body to inhibit entry of external contaminants.

In use, the consumer removes the top lid of the stick and rotates the disc blade so that it is out of the way of the opening. The actuator is then used to push the product through the opening, exposing the desired amount for application. Once the desired amount is exposed, the disc cutter element is rotated back across the opening. This action cuts or scrapes the exposed top end of the product onto the top of the disc cutter, leaving the remaining product protected within the stick body, shielded from external contaminants.

Each of these features contributes to a dispensing stick design that addresses the limitations of conventional mechanisms, offering both hygiene and protection of the dispensed product.

BRIEF DESCRIPTION OF THE DRAWINGS

Various embodiments of the invention are disclosed in the following detailed description and accompanying drawings.

Figure 1A:
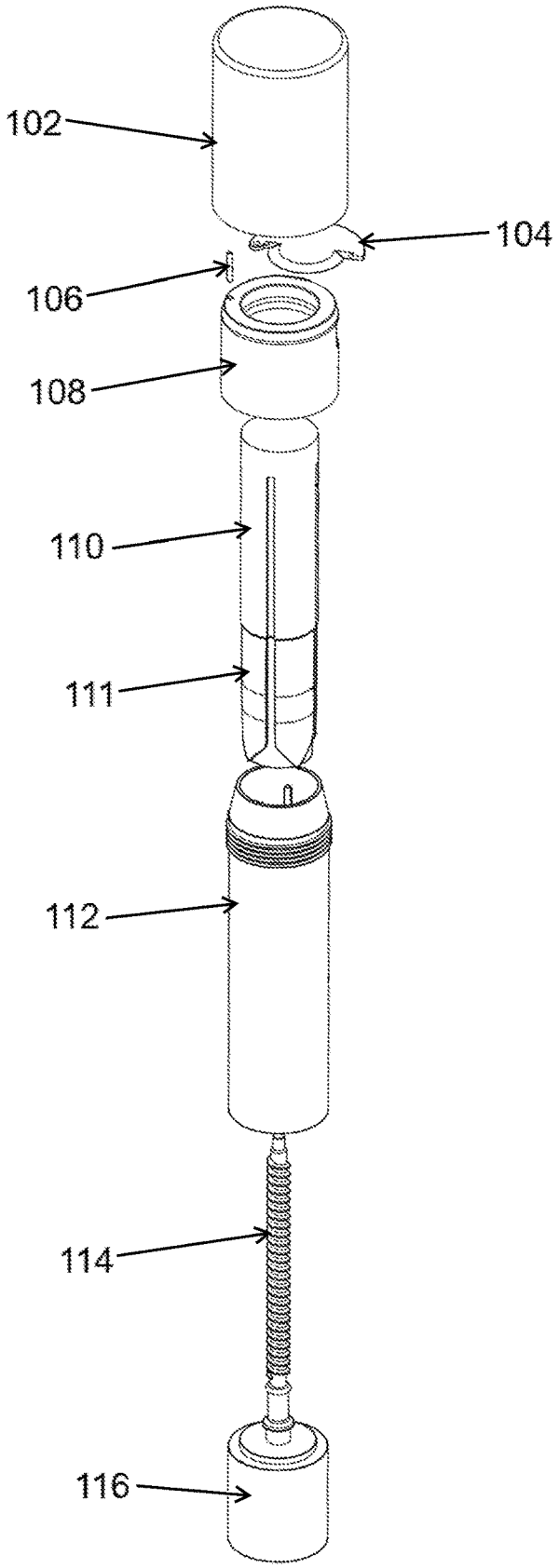
FIG. 1A shows a first exploded components view of the dispensing stick, detailing its individual elements.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

Definitions

The terminology used herein is for the purpose of describing particular embodiments only and is not intended to be limiting of the invention.

As used herein, the term "and/or" includes any combinations of one or more of the associated listed items.

As used herein, the singular forms "a," "an," and "the" are intended to include the plural forms as well as the singular forms, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The terms "first," "second," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

DESCRIPTION OF DRAWINGS

The present invention relates to a dispensing stick, particularly designed to dispense semi-solid products such as lip balm, lipstick, and glue. The dispensing stick features a cylindrical body, an actuator mechanism, and a unique rotatable disc-shaped cutter element adjacent to the dispensing opening. The cylindrical body houses the product and includes an opening at one end to permit dispensing. The actuator mechanism, located at the opposite end, serves the function of pushing the product through the opening for application. The rotatable disc-shaped cutter element is distinctively positioned and hinged to the cylindrical wall of the body near the opening. This cutter element incorporates a curved blade protruding from one edge and is coupled to the body by a pin. An aperture in the wall of the body accommodates the rotation of the disc-shaped cutter, allowing it to operate along a plane parallel to the opening. In this manner, the invention enables a cutting action as the product is pushed out for application.

FIG. 1A provides a first exploded components view of the dispensing stick, delineating its various elements. At the uppermost part of the figure is the outer lid 102, designed to cover the dispensing opening when the product is not in use. Positioned directly beneath the outer lid 102 is the disc cutter 104, which features a curved blade. This disc cutter 104 is designed to be pivotally attached to the top portion of the stick body 108 via pin 106.

Located below the disc cutter 104 and pin 106 is the top portion of the stick body 108, to which the disc cutter 104 will be mounted. This portion includes an aperture that allows the disc cutter 104 to rotate freely when coupled via the pin 106. Underneath the top portion of the stick body 108 is the product 110, which can be a variety of semi-solid substances such as lipstick or lip balm. The product 110 is held on a mount 111 that facilitates its smooth elevation when the actuator is operated.

Below the product 110 and its mount 111 is the bottom portion of the stick body 112. This bottom portion houses the screw dispensing mechanism 114, which interfaces with the twist lid actuator 116 at the very bottom of the figure. The twist lid actuator 116 serves as the component that a user interacts with to operate the screw dispensing mechanism 114, ultimately pushing the product 110 through the dispensing opening.

Figure 1B:
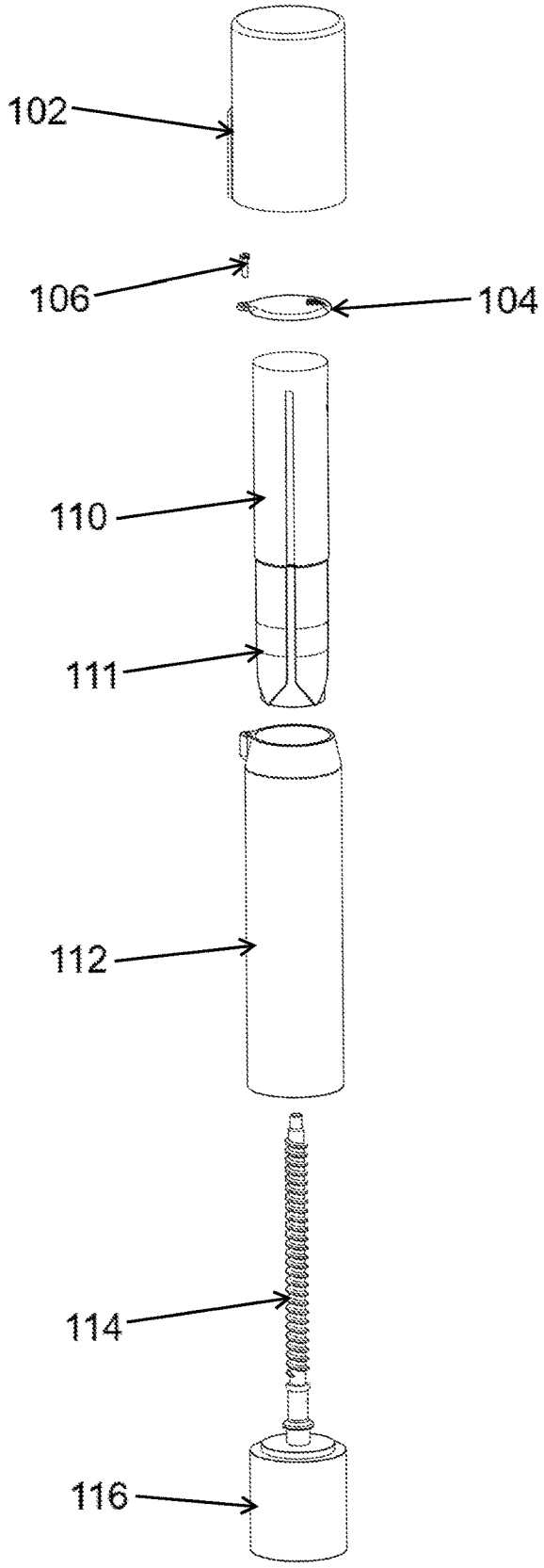
FIG. 1B is another exploded components view of the dispensing stick, similar to FIG. 1A but without the top portion of the stick body.

FIG. 1B shows an exploded components view similar to that of FIG. 1A but omits the top portion of the stick body 108. This view allows for a more focused examination of how the remaining elements interact, particularly emphasizing the relationship between the product 110 on its mount, the bottom portion of the stick body 112, the screw dispensing mechanism 114, and the twist lid actuator 116. Without the top portion 108, it becomes easier to see how the lower components fit together in the assembled state.

Figure 2A:
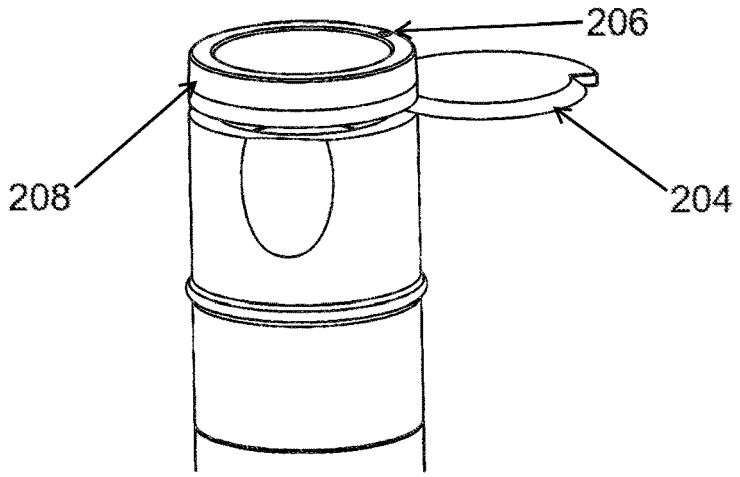
FIG. 2A and FIG. 2B present perspective views of the fully assembled dispensing stick with the disc cutter in an open position, rotated to be outside of the stick body.

FIG. 2A displays a perspective view of the assembled dispensing stick with the disc cutter 204 in an open position, rotated to be outside the stick body 208 and 212. In this state, the disc cutter 204 is moved away from the dispensing opening of the top portion of the stick body 208, permitting unobstructed access to the product 210 within. The twist lid actuator 216 is also visible, indicating that it is ready for user interaction to elevate the product 210 via the screw dispensing mechanism (See FIG. 1 element 114).

Figure 2B:
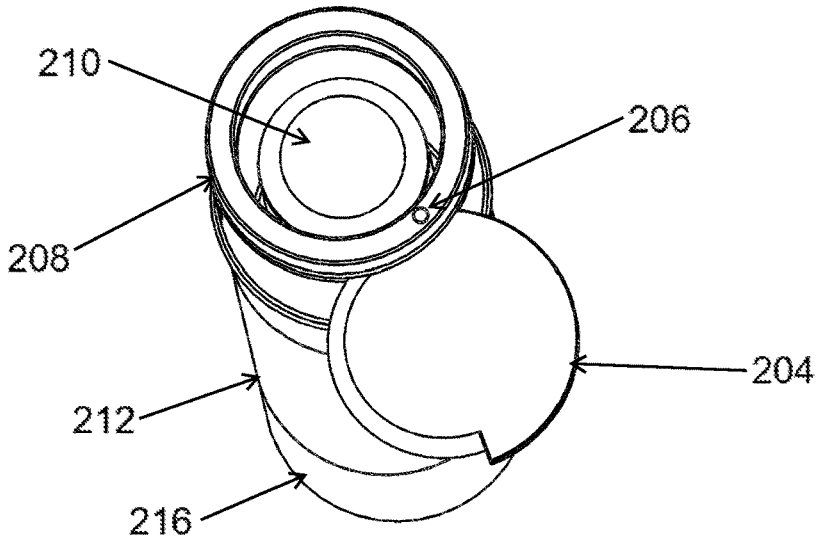

FIG. 2B offers another perspective view similar to FIG. 2A but from a different angle, again showing the disc cutter 204 in an open position. This view further accentuates the spatial relationship between the disc cutter 204 and the top portion of the stick body 208, demonstrating how the disc cutter 204 rotates around pin 206. It also provides additional visibility of the bottom portion of the stick body 212 and the twist lid actuator 216, which is the interface for operating the screw dispensing mechanism (See FIG. 1 element 114).

Figure 2C:
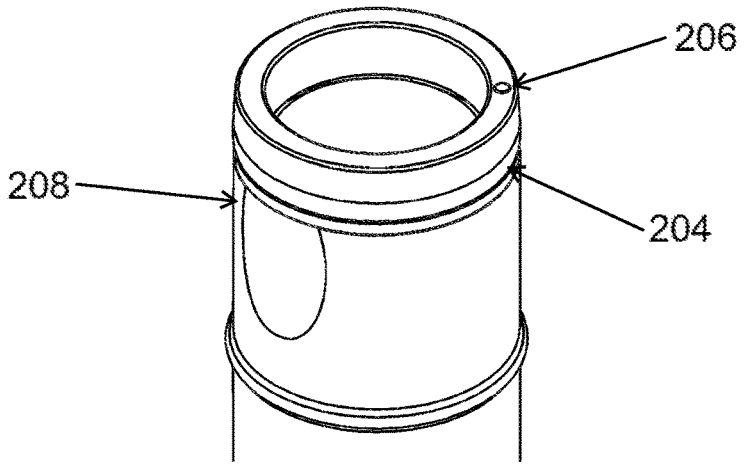
FIG. 2C offers a perspective view of the assembled dispensing stick with the disc cutter in a closed position, rotated inside the stick body.

FIG. 2C presents a perspective view of the assembled dispensing stick, but in this depiction, the disc cutter 204 is in a closed position, rotated inside the stick body 208 and 212. In this state, the disc cutter 204 has sliced/scraped through the top of the stick product 210 and is now aligned with the rest of the stick dispenser body 208 and 212. The curved blade of the disc cutter 204 in this position will have separated a small portion of the product (lip balm/lipstick/glue, etc.) from the main body of the product stick. The small separated portion will rest on top of the disc cutter 204 within the small chamber formed by the top end of the upper stick body part 208, while the main body of the stick product will be enclosed by the lower dispenser body 212 underneath the disc cutter 204.

The twist lid actuator 216 is also present, suggesting that the user can now operate it to retract the product 210 back into the stick body 208 and 212, if necessary. The closed position of the disc cutter 204 effectively limits exposure of the main body of the stick product 210 to external contaminants when not in use.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the dispensing stick have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A dispensing stick for dispensing a product, the dispensing stick comprising:

a cylindrical body having an inner cavity for storing the product and an opening at one end for dispensing the product;

an actuator mechanism located at the opposite end of the cylindrical body, operable to push the product through said opening;

a rotatable disc-shaped cutter element, having a curved blade protruding from one edge, hingedly coupled to the cylindrical wall of said body adjacent to said opening;

a pin coupling said disc-shaped cutter element to said cylindrical body, wherein said pin is positioned at one outer edge of said disc-shaped cutter element;

an aperture in the wall of said cylindrical body at the point of coupling, allowing said disc-shaped cutter element to rotate around said pin along a plane parallel to the opening of the cylindrical body.

2. The dispensing stick of claim 1, wherein the disc-shaped cutter element comprises a circular profile.

3. The dispensing stick of claim 1, wherein the disc-shaped cutter element comprises a semi-circular profile.

4. The dispensing stick of claim 1, wherein the actuator mechanism is a screw-based mechanism.

5. The dispensing stick of claim 1, wherein the actuator mechanism is a spring-loaded mechanism.

6. The dispensing stick of claim 1, further comprising a removable top lid covering said disc-shaped cutter element.

7. The dispensing stick of claim 6, wherein the removable top lid includes a locking mechanism to secure said lid onto the cylindrical body.

8. The dispensing stick of claim 1, wherein the disc-shaped cutter element is configured to cut the product once the actuator mechanism has pushed the product through the opening.

9. The dispensing stick of claim 1, wherein the curved blade of the disc-shaped cutter element is replaceable.

10. The dispensing stick of claim 1, wherein the cylindrical body is comprised of a material selected from the group consisting of plastic, metal, and biodegradable materials.

11. The dispensing stick of claim 1, wherein the dispensing stick is adapted to dispense a product selected from the group consisting of lip balm, lipstick, and glue.

12. The dispensing stick of claim 1, wherein the aperture in the wall of the cylindrical body is elongated to guide the rotation of the disc-shaped cutter element.

13. The dispensing stick of claim 1, wherein the pin coupling the disc-shaped cutter element to the cylindrical body is made of a material selected from the group consisting of metal and plastic.

14. The dispensing stick of claim 1, further comprising a sealing gasket positioned between the disc-shaped cutter element and the opening of the cylindrical body to inhibit entry of external contaminants.

* * * * *